United States Patent [19]

Pacanowsky et al.

[11] 3,993,514

[45] Nov. 23, 1976

[54] GAS GENERATING COMPOSITIONS CONTAINING AMMONIUM SULFATE ACCELERATION FORCE DESENSITIZER

[75] Inventors: Eugene J. Pacanowsky, Elkton, Md.; Eugene A. Martino, Newark, Del.

[73] Assignee: Thiokol Corporation, Newtown, Pa.

[22] Filed: Jan. 27, 1972

[21] Appl. No.: 221,169

[52] U.S. Cl. ..... 149/19.5; 149/19.6; 149/19.9; 149/19.91; 149/76

[51] Int. Cl.[2] ..... C06B 45/10

[58] Field of Search ..... 149/19, 76, 85, 19.6, 149/19.9, 19.5, 19.91

[56] References Cited

UNITED STATES PATENTS

| | | | |
|---|---|---|---|
| 2,411,070 | 11/1946 | Van Karner | 149/85 X |
| 3,147,160 | 9/1964 | McCrone | 149/76 X |
| 3,203,842 | 8/1965 | Godfrey | 149/19 |
| 3,214,304 | 10/1965 | Vriesen | 149/19 |
| 3,467,558 | 9/1969 | Wernette et al. | 149/85 X |
| 3,476,622 | 11/1969 | Harada et al. | 149/19 |
| 3,734,789 | 5/1973 | Moy et al. | 149/19.6 X |
| 3,846,195 | 11/1974 | Zimmerman et al. | 149/19.6 X |

*Primary Examiner*—Edward A. Miller

[57] ABSTRACT

A gas generating composition having decreased sensitivity to compressive acceleration forces. The composition comprises an intimate mixture of ammonium perchlorate oxidizer and elastomeric fuel binder in such proportions as to provide a burning rate of 0.05 to 0.3 inches per second at a pressure of 1000 p.s.i.a. and has incorporated therein 5 to 35% of ammonium sulfate as an acceleration force desensitizing agent.

11 Claims, 7 Drawing Figures

Figure 1:
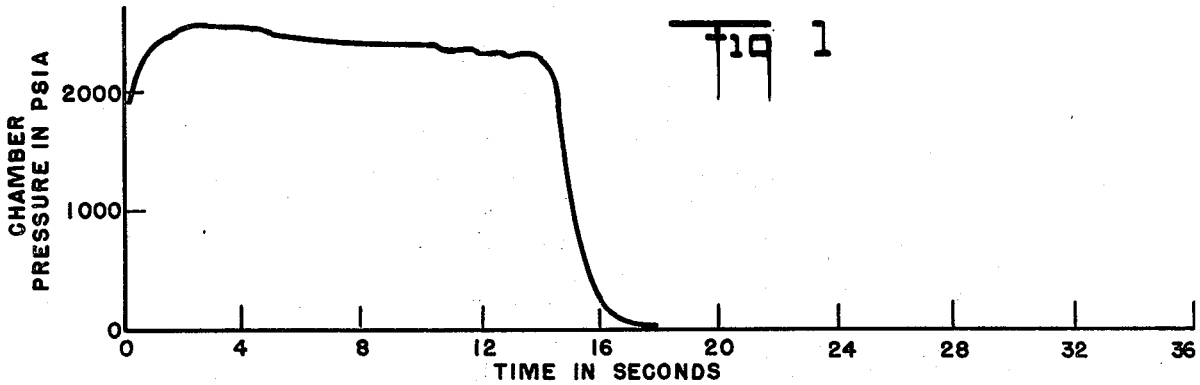

CHAMBER PRESSURE IN PSIA
2000
1000
0
0 4 8 12 16 20 24 28 32 36
TIME IN SECONDS

CHAMBER PRESSURE IN PSIA
1000
0
0 4 8 12 16 20 24 28 32 36
TIME IN SECONDS

CHAMBER PRESSURE IN PSIA
2000
1000
0
0 4 8 12 16 20 24 28 32 36
TIME IN SECONDS

CHAMBER PRESSURE IN PSIA
2000
1000
0
0 4 8 12 16 20 24 28 32 36
TIME IN SECONDS

CHAMBER PRESSURE IN PSIA
1000
0
0 4 8 12 16 20 24 28 32 36
TIME IN SECONDS

GAS GENERATING COMPOSITIONS CONTAINING AMMONIUM SULFATE ACCELERATION FORCE DESENSITIZER

This invention relates to gas generators, and more particularly, to gas generating compositions that have a decreased sensitivity to the effects of acceleration forces.

Gas generators are portable, compact primary power units, often referred to as auxiliary power units, containing gas generating compositions which, when ignited, generate gases under pressure that can be used as motive power for a variety of mechanical applications. The gas generating compositions used in such gas generators are solid compositions that support combustion and produce gases in the absence of atmospheric air. The gases thus produced can be used, for example, to pressurize a fluid or drive a turbine to produce mechanical or electrical energy, to actuate safety brakes on vehicles or to start various mechanical devices. Such gas generating devices are capable of producing a rather substantial amount of power per unit of weight as compared to conventional gas or oil energized generators. Because of their high power to weight ratio, these devices are especially suited for use in aerospace and missile applications.

In some respects, gas generating compositions are similar to solid propellant compositions used to power rockets and missiles. Like missile propellant compositions, gas generating compositions must fulfill certain stringent physical requirements to be acceptable. For example, like missile propellant compositions, gas generating compositions should be ballistically stable after prolonged storage at extreme temperatures ranging from as high as 180° F. to as low as −80° F. In addition, particularly for aerospace and missile applications, the compositions must be readily ignitable within these same temperature ranges. Furthermore, the compositions must be relatively insensitive to shock, have substantial elasticity to minimize gaps or voids and must burn evenly and consistently. Finally, both types of compositions consist essentially of an oxidizer and a combustible fuel binder, ordinarily supplemented by small quantities of various special purpose additives. It should be noted that the additives are optional components of the compositions and will vary in type and content from composition to composition.

While as indicated above there are several areas of similarity between gas generating compositions and propellant compositions, the differences between the two types of compositions are quite important. Thus gas generating compositions, unlike propellant compositions, should have a relatively slow burning rate and burn at relatively low flame temperatures. Another requirement is that the combustion of the gas generating compositions should desirably generate essentially particle free gases that are relatively non-erosive. In addition, ideally the burning rate of the gas generating composition should be as independent as possible of the temperatures and pressures produced during combustion. The need for these special requirements arises because of the different purposes for which the two compositions are designed. For example, the combustion of missile propellants produces exceedingly high flame temperatures, often in excess of 4000° C. These high flame temperatures are destructive to parts fabricated of the common commercial metal alloys such as the stainless steels over any sustained period of time. In fact, prolonged exposure to these higher temperatures produces deterioration of many of the specially formulated so-called "heat-resistant alloys." The erosion and corrosion of the metal missile parts that occurs during combustion is of little importance in missiles since they are designed as expendable "one-shot" pieces of hardware. Similarly, the presence of erosive or corrosive combustion products as evidenced by smoky combustion gases causes little concern.

In contrast, the effect of high combustion temperatures and erosive solid particles in the combustion gases on gas turbine-type engines is more serious. For example, the solid particles not only erode the metal parts they contact but they can clog the movable engine parts of engines for which they are used as a source of motive fluid, thus impairing engine performance as well as causing engine failure. This increases maintenance costs and reduces useful engine life. Since power generating devices are designed for long term use, dependability and long life are important for commercial acceptance. Thus, the typical missile propellant composition of the prior art has little value as a gas generating composition.

Typical gas generator compositions have burning rates of the order of 0.05 to 0.3 inches per second at a pressure of 1000 p.s.i.a. and produce gases having temperatures below about 2500° F. The attainment of relatively low gas temperatures can be promoted by incorporating in the gas generating composition any of various known coolants.

In general, gas generating compositions have the desirable characteristic of producing a substantially horizontal pressuretime trace, that is to say, the combustion chamber pressure remains substantially constant for almost the entire period between ignition and burn-out. However, in certain applications the gas generator is subjected to accelerative forces, and it has been found that such accelerative forces have a significant effect upon the burning characteristics of the gas generating compositions. More particularly, an accelerative compressive force exerted on the gas generating composition may cause the gas pressure to increase significantly during the burning period. For example, a compressive force of as little as 5 g to 10 g may produce a progressive pressure increase of as much as 10% to 40% or more between ignition and burn-out. Such a pressure increase in the combustion chamber of the gas generator is highly undesirable since it produces a non-uniform flow of motive gas. It has been found that the known burning rate modifiers have little, if any, effect in preventing this pressure increase.

It is accordingly an object of the present invention to provide a gas generating composition which is substantially insensitive to the effects of accelerative forces. It is another object of the invention to provide a gas generating composition which generates a substantially constant combustion chamber pressure even when subjected to compressive accelerative forces of as much as 150 g of more. Other objects of the invention will be in part obvious and in part pointed out hereafter.

The present invention is predicated on the discovery that the burning rate of gas generating compositions can be rendered substantially insensitive to the effects of compressive accelerative forces by incorporating in the composition a suitable amount of ammonium sulfate. In fact in some cases compositions containing ammonium sulfate exhibit a slightly progressive decrease in combustion chamber pressure when subjected to compressive accelerative forces. Moreover, ammonium sulfate also shows a coolant effect, i.e., it tends to reduce to some extent the flame temperature of the gas generating composition in which it is incorporated, thus making it unnecessary in some cases to add a separate coolant to the composition.

The amount of ammonium sulfate to be used in the composition depends upon such factors as the nature of the oxidizer and fuel binder used and the magnitude of the accelerative force to which the generator is to be subjected. In most cases the desired effect can be attained by using from 5% to 35% by weight of the ammonium sulfate, based on the total weight of the gas generator composition. The preferred proportion of ammonium sulfate is from 15% to 25% by weight.

The finely divided oxidizers used in the present compositions are perchlorate salts such as ammonium perchlorate and the alkali metal and alkaline earth metal perchlorates. The preferred oxidizer is ammonium perchlorate since it minimizes solid residues. However, salts such as sodium, potassium, calcium and barium perchlorates may also be used. As is known in the art, the oxidizer may be used in multi-modal form, that is, a mixture of two or more different particle sizes of the oxidizer may advantageously be used.

In general, any of the fuel binders known to be useful in gas generator compositions may be employed in preparing the present composition. As is known in the art, gas generator compositions are ordinarily formulated by thoroughly mixing with the oxidizer and special purpose additives a liquid polymer and curing agent capable of curing the polymer to solid form, and then heating the mixture to convert the liquid polymer to solid, usually elastomeric form. The liquid polymer forming the basis of the fuel binder may be, for example, a linear polyester with functional groups such as carboxyl or hydroxyl groups, a hydroxyl- or carboxyl-terminated linear aliphatic hydrocarbon, a polyurethane prepolymer, a polythiopolymercaptan, a butadiene-acrylic acid copolymer, a butadiene-acrylo-nitrile-acrylic acid copolymer, a butadiene-vinylpyridine copolymer, a polyacrylate, a polycarbonate or blends of said liquid polymers. The polyurethanes may be plasticized with nitro or nitrato esters, e.g., diethylene glycol dinitrile, trimethylolethane trinitrate and the like. Double base systems may also be used as the binder or binder-oxidizer, e.g., nitrocellulose, nitroglycerine or cellulose acetate, which can be plasticized with nitro compounds, nitrato esters or triacetin. In general, the oxygenated fuel binders, e.g., the polyesters give somewhat lower burning rates.

The polyesters having functional terminals used as fuel binders in the present compositions may be prepared in known manner by reacting dicarboxylic acids with diols under temperature and pressure conditions known in the art. Typical dicarboxylic acids useful in preparing the polyesters include oxalic, succinic, adipic, sebacic, maleic and fumaric acids and others, as well as mixtures of these acids. The diols used may include ethylene glycol, diethylene glycol, triethylene glycol, propylene glycol, polybutylene and polypropylene glycols, alkane diols, castor oil and the like. Minor amounts of polybasic acids such as itaconic and polyhydric alcohols such as glycerols, sorbitols and pentaerythritol may be included in the reaction mixture. The liquid polyesters preferably have a molecular weight of 500 to 5000.

The carboxyl-terminated aliphatic hydrocarbons may be carboxyl-terminated butadiene polymers prepared as described in Berenbaum U.S. Pat. No. 3,235,589 and may have a molecular weight within the range 500 to 10,000. The carboxyl-terminated acrylobutadiene copolymers may be prepared as disclosed in Lowrey et al. U.S. Pat. No. 3,595,717 and may have molecular weights within the range 1000 to 7000. The liquid polyurethane prepolymers may be prepared in known manner by reacting diisocyanates and polyisocyanates with carboxyl-terminated polyesters or polyethers, or known commercial types of liquid polyurethane polymers may be used. The liquid polythiopolymercaptans may be prepared as disclosed in U.S. Pat. No. 2,466,963 and may have molecular weights in the range 1000 to 5000. The liquid prepolymers used as fuel binders are cured according to curing techniques well known in the resin art using polymerization catalysts, curing agents or accelerators commonly used. For example, the polyesters may be cured at temperatures ranging from 80° to 180° F. using the usual curing agents such as polyepoxides, polyamines and the like. Similarly the polyurethane prepolymers can be cured at temperatures varying between ambient and 250° F. when treated with curing agents such as polyols. The carboxyl-terminated hydrocarbon polymers and acrylobutadiene copolymers such as the acrylic acid butadiene copolymers can be conveniently cured with polyepoxides, e.g., trifunctional epoxide resins based on p-amino-phenol, aziridines and epoxide aziridines in known manner. Small amounts of curing catalysts of the metal salt type, e.g., iron, chromium, or stannous salts of linoleic or 2-ethyl hexanoic acid may be used in conjunction with the polyepoxide curing agent. The liquid polythiopolymercaptans can be cured with various oxidizing agents as disclosed in U.S. Pat. No. 2,466,963.

In addition to the perchlorate oxidizer, cured elastomeric fuel binder and ammonium sulfate desensitizer, the present compositions may contain a variety of special purpose additives. These may include plasticizers such as alkyl phthalates and the like, darkening agents such as carbon black and various combustion catalysts and/or burning rate modifiers and/or coolants such as, for example, ammonium dichromate, dihydroglyoxine, oxamide, cobalt dicyclopentadiene, ferric and cobalt acetonate and the like. The special purpose additives are optional components of the present compositions and may be present in the composition to the extent of say 0% to 10% by weight of the composition.

In general, the present compositions comprise:

1. From 40% to 70% by weight of finely divided inorganic perchlorate oxidizer, preferably ammonium perchlorate,
2. From 10% to 35% of elastomeric combustible fuel binder,
3. From 5% to 35% of an acceleration force desensitizer which is ammonium sulfate, and
4. From 0 to 10% by weight of the special purpose additives referred to above.

In preparing the present compositions the perchlorate oxidizer in finely divided form and the liquid fuel binder and curing agent therefor, and the ammonium sulfate desensitizer also in finely divided form are placed in a mixer together with the special purpose additives if required and thoroughly mixed. The mixing time required to achieve the desired degree of uniformity varies according to the batch size and properties of the ingredients used such as viscosity of the fuel binder prepolymer, the nature of the curing agent, and particle size of the oxidizer and desensitizer. Ordinarily at least 30 minutes is required to achieve the desired uniformity. The mixed composition is introduced into a suitable casing, usually having a nozzle outlet, and is cured in situ in the casing at a temperature which in most cases falls in the range 80° to 200° F. The particular curing temperatures required to cure the liquid prepolymers described above is known in the art.

In order to illustrate further the nature of the present invention the following Examples are given. In these Examples the components of the composition are given in parts by weight. The compositions were incorporated in gas-generating casings as described above and tested to determine their burning characteristics when subjected to several different accelerator forces. The pressure traces obtained with the compositions are illustrated in FIGS. 1 to 5 of the accompanying drawing, the several FIGURES of the drawing being identified in the Examples.

EXAMPLE 1

A gas generating composition was prepared in the manner described above containing the following ingredients in the indicated proportions:

| Ingredient | Parts by Weight |
|---|---|
| Carboxyl-terminated hydrocarbon polymer (average molecular weight about 4000) - HC 434 | 22.73 |
| Curing Agent - tri-glycidyl ether of p-aminophenol - (ERL-0500) containing a small amount of curing catalyst | 1.17 |
| Carbon Black (Thermax) | 0.10 |
| Ammonium Sulfate (Average particle size - 190 microns) | 16.00 |
| Ammonium Perchlorate (Average size - 200 microns) | 48.00 |
| Ammonium Perchlorate (Average size - 12 microns) | 12.00 |

The foregoing composition was cured for 72 hours at 150° F.

Figure 2:
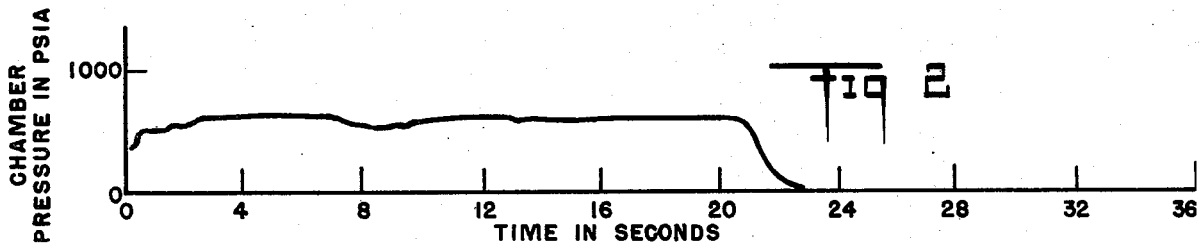
Figure 3:
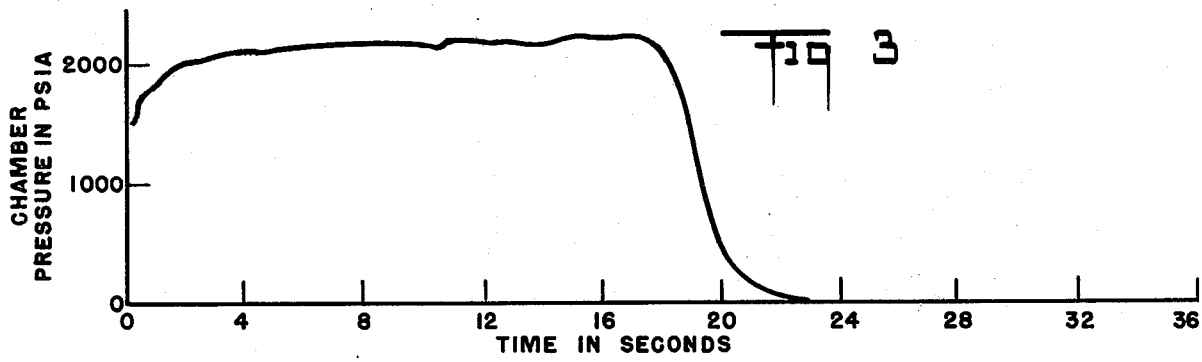

Gas generators containing the foregoing composition were tested at compressive accelerative forces of 18 g's and 137 g's with the results shown in FIGS. 1 to 3 of the drawings. FIG. 1 shows the pressure trace for the generator tested at 18 g's. It will be noted that after an initial pressure surge at the time of ignition followed by a sharp pressure drop the pressure leveled off at about 2500 p.s.i.a. and decreased slightly as the propellant burned. This contrasts with pressure traces for gas generator compositions which do not contain the ammonium sulfate desensitizer which, when subjected to an accelerative force of this magnitude, commonly show a progressive increase in pressure during most of the burning period between ignition and burn-out.

FIG. 2 shows the pressure trace for a gas generator tested at a compressive accelerative force of 137 g's. In this test the gas generator nozzle had a larger orifice than the generator of Example 1 and thus the pressure was about 600 p.s.i.a. FIG. 2 shows that even at this relatively high g level the pressure remained substantially constant throughout the burning period.

FIG. 3 shows the pressure trace for a third gas generator tested at 137 g's and having a nozzle orifice of such size that the pressure was of the order of 2100 p.s.i.a. While FIG. 3 shows a slight increase in pressure during the burning period, the pressure trace is very nearly horizontal.

EXAMPLE 2

Gas generators were made in the manner described above incorporating gas generating compositions having the following formulation of ingredients in parts by weight:

| Ingredient | Parts by Weight |
|---|---|
| Carboxyl-terminated hydrocarbon polymer (average molecular weight about 4000) HC-434 | 22.73 |
| Curing Agent - triglycidyl ether of p-aminophenol - (ERL-0500) containing a small amount of curing catalyst | 1.17 |
| Carbon Black (Thermax) | 0.10 |
| Ammonium Sulfate (Average particle size - 190 microns) | 21.00 |
| Ammonium Perchlorate (Average size - 200 microns) | 44.00 |
| Ammonium Perchlorate (Average size - 12 microns) | 11.00 |

Figure 4:
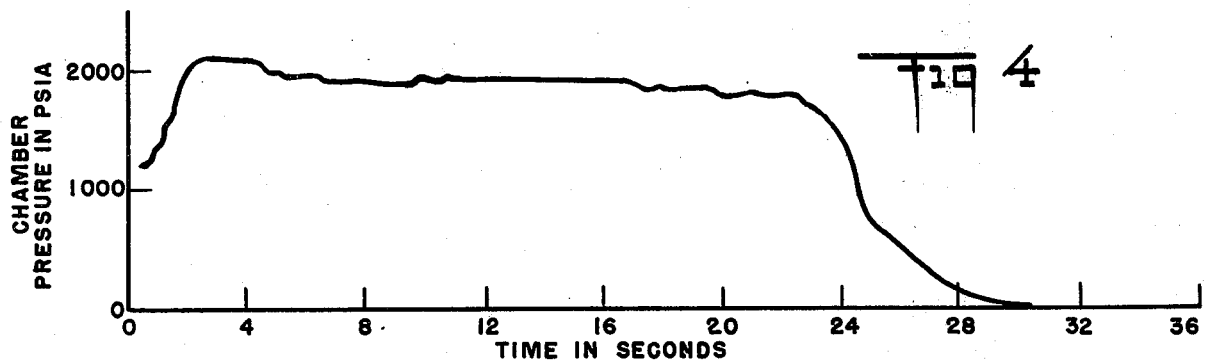
Figure 5:
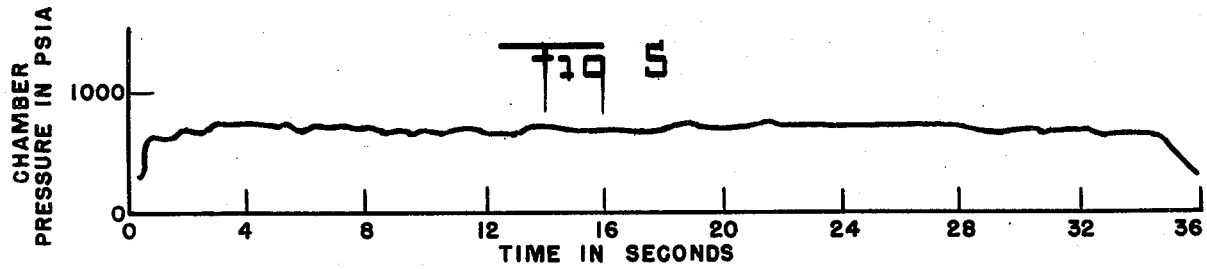

Gas generators containing the foregoing compositions were tested at compressive accelerative forces of 17 g's and 137 g's and the pressure traces obtained are shown in FIGS. 4 and 5 of the drawing. FIG. 4 shows that for the main part of the burning period the pressure decreased from about 2100 p.s.i.a. to about 1800 p.s.i.a. FIG. 5 shows that the gas generator tested at 137 g's (using a nozzle having a somewhat larger orifice) exhibited a pressure trace which remained substantially constant at about 800 p.s.i.a. for most of the burning period.

EXAMPLE 3

A gas generator was made in the manner described above having a gas generating composition of the following formulation:

| Ingredient | Parts by Weight |
|---|---|
| Diethylene glycol adipate polyester Moleclar weight 2000 | 26.05 |
| Curing Agent - triglycidyl ether of p-aminophenol | 3.75 |
| Carbon black - (Thermax) | 0.10 |
| Iron octoate | 0.15 |
| Ammonium sulfate (Average particle size - 190 microns) | 19.0 |
| Ammonium perchlorate (Average size - 200 microns) | 35.7 |
| Ammonium perchlorate (Average size - 12 microns) | 15.3 |

Figure 6:
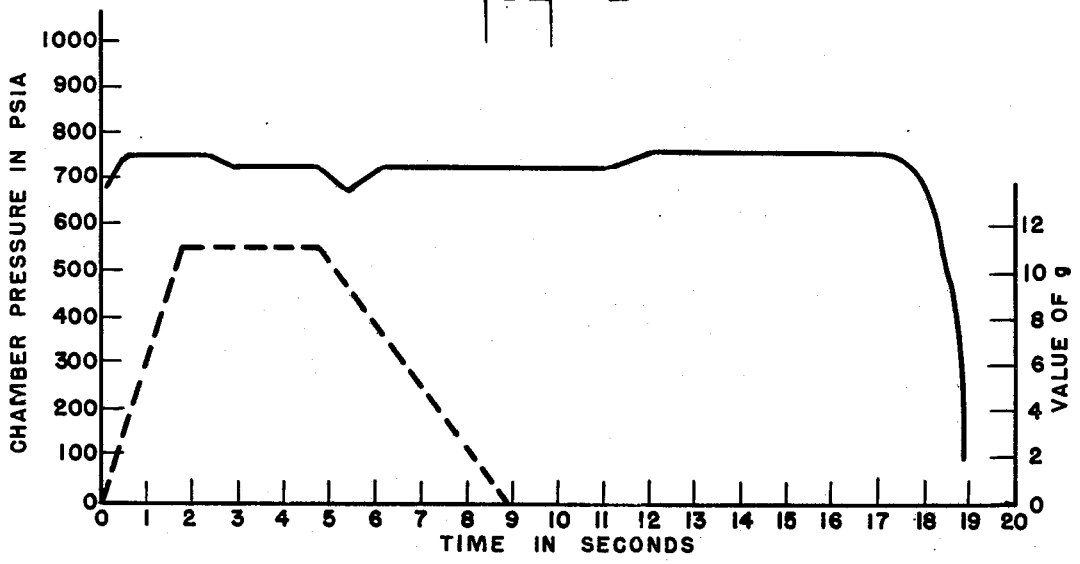

A gas generator containing the foregoing composition was tested at a varying compressive accelerative force is indicated in FIG. 6. More particularly, the accelerative force was increased at a uniform rate during the first 1.7 seconds to 11 g, maintained at 11 g for about 3 seconds and then reduced to zero over a period of about 4 seconds.

The pressure trace for this composition shows that the chamber pressure remained substantially constant between ignition and burn-out. During the period when the g value was increasing the chamber pressure rose to about 750 p.s.i.a. During the period of constant g value the chamber pressure actually dropped a small amount to about 720 p.s.i.a. After the g value had been reduced to zero the chamber pressure again attained a value of about 750 p.s.i.a. The significant point in relation to the trace is that increase in accelerative force did not produce an increase in chamber pressure.

EXAMPLE 4

This Example illustrates the manner in which chamber pressure increases when a gas generating composition is used that contains a conventional coolant rather than the acceleration desensitizer of the present invention. A gas generator was made having a gas generating composition as follows:

| Ingredient | Parts by Weight |
|---|---|
| Carboxyl-terminated hydrocarbon (average molecular weight about 4000) | 18.75 |
| Curing agent - triglycidyl ether of p-aminophenol | 1.0 |
| Dihydroxyglyoxine | 27.0 |
| Oxamide | 5.0 |
| Carbon black (Thermax) | 0.25 |
| Ammonium perchlorate (Average particle size - 190 microns) | 43.2 |
| Ammonium perchlorate (Average particle size - 12 microns) | 4.8 |

Figure 7:
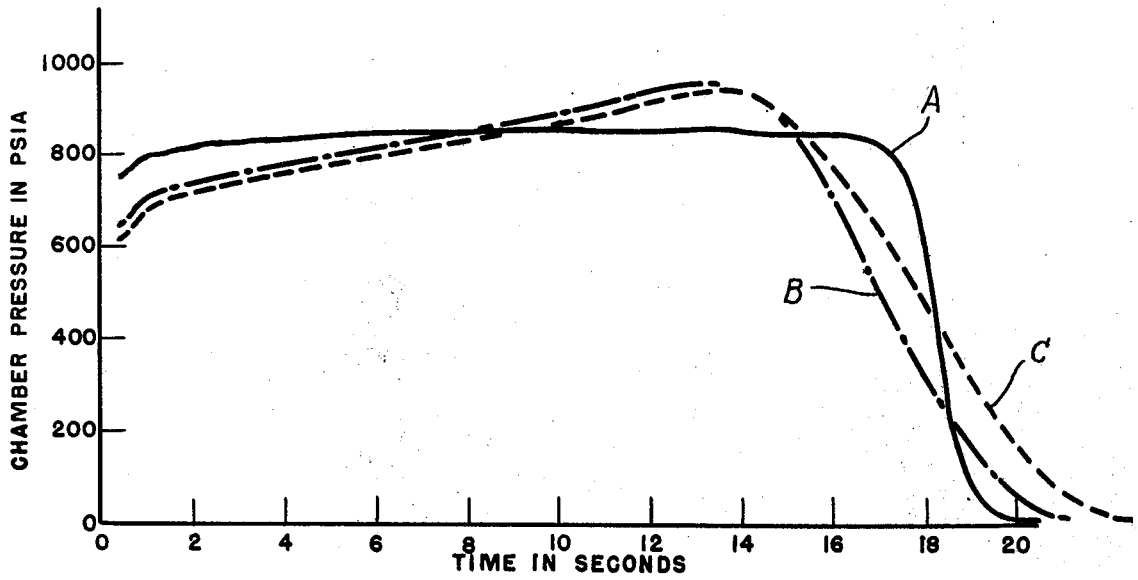

Gas generators containing the foregoing composition were tested at zero g, 11 g and 15.5 g with the results shown in FIG. 7. In FIG. 7, curve A is the pressure trace for zero g, curve B is the pressure trace for 11 g and curve C is the pressure trace for 15.5 g. It will be noted that at zero g, ignoring the pressure variations during the first second after ignition, the pressure trace for most of the period between ignition and burn out remained fairly constant. On the other hand, at 11 g and 15.5 g the pressure increased during this same period from about 700 p.s.i.a. to about 950 p.s.i.a.

It should also be noted that curves B and C show a relatively slow tapering off of chamber pressure during the latter part of the burning period rather than the relatively sharp pressure drop of curve A. This gradual decrease in chamber pressure during the latter part of the burning period is an undesirable characteristic in a gas generating composition.

From the foregoing description and Examples it should be apparent that the present invention provides gas generator compositions which because of the presence of the ammonium sulfate acceleration force desensitizer therein burn with a substantially horizontal pressure trace and avoid the undesired progressive increase in pressure characteristic of the previously proposed gas generator compositions when subjected to large acceleration forces. As pointed out above, the added ammonium sulfate also appears to operate as a coolant and thus makes it possible to obtain a gas generating composition with a relatively low flame temperature without any added coolant or with only a minor amount of such added coolant.

It is, of course, to be understood that the foregoing Examples are intended to be illustrative only and that numerous changes can be made in the proportions, ingredients and conditions disclosed without departing from the spirit of the invention as defined in the appended claims.

We claim:

1. A solid combustible gas generating composition having a decreased sensitivity to acceleration forces comprising an intimate mixture of 40% to 70% by weight of finely divided inorganic perchlorate oxidizer, 10% to 35% by weight of an elastomeric combustible binder selected from epoxide cured polyester and epoxide cured hydrocarbon polymers and 5 to 35% of an acceleration force desensitizer which is ammonium sulfate.

2. A composition according to claim 1 wherein said binder is an epoxide-cured condensation polymer of adipic acid and diethylene glycol.

3. A composition according to claim 1 wherein said binder is an epoxide-cured copolymer of acrylic acid and butadiene.

4. A composition according to claim 1 wherein said binder is an epoxide-cured copolymer of acrylonitrile, butadiene and acrylic acid.

5. A composition according to claim 1 wherein said binder is an epoxide-cured carboxyl-terminated hydrocarbon polymer.

6. A composition according to claim 1 wherein said oxidizer is ammonium perchlorate.

7. A solid combustible gas generating composition having a burning rate of 0.05 to 0.3 inches/second at 1000 p.s.i. and a decreased sensitivity to acceleration forces, said composition comprising an intimate mixture of combustible, oxygen-containing, organic binder selected from epoxide cured polyester and epoxide cured hydrocarbon polymers, a quantity of finely divided inorganic perchlorate oxidizer sufficient to effect substantially complete combustion of said binder when said composition is ignited and from 5% to 35% by weight of said composition of an accelerating force desensitizer which is ammonium sulfate.

8. A solid combustible gas generating composition having a decreased sensitivity to acceleration forces consisting essentially of an intimate mixture of 40 to 70% by weight of finely divided ammonium perchlorate, 10 to 35% by weight of an elastomeric combustible fuel binder selected from epoxide cured polyester and epoxide cured hydrocarbon polymers, 5 to 35% of an acceleration force desensitizer which is ammonium sulfate and 0 to 10% by weight of one or more propellant additives.

9. A gas generating composition according to claim 8 wherein the ammonium sulfate is present to the extent of 15% to 25% by weight of said composition.

10. A solid combustible gas generating composition comprising an intimate mixture of 40% to 70% by weight of finely divided inorganic perchlorate oxidizer, 10% to 35% by weight of an elastomeric combustible binder selected from epoxide cured polyester and epoxide cured hydrocarbon polymers and 5 to 35% by weight of ammonium sulfate.

11. A solid combustible gas generating composition having a burning rate of 0.05 to 0.3 inches/second at 1000 p.s.i., said composition comprising an intimate mixture of combustible, oxygen-containing, organic binder selected from epoxide cured polyester and epoxide cured hydrocarbon polymers, a quantity of finely divided inorganic perchlorate oxidizer sufficient to effect substantially complete combustion of said binder when said composition is ignited and from 5% to 35% by weight of said composition of ammonium sulfate.

* * * * *